US006059488A

United States Patent [19]

Green

[11] Patent Number: 6,059,488

[45] Date of Patent: May 9, 2000

[54] RAISED ROAD MARKER

[75] Inventor: John L. Green, Sedro Woolley, Wash.

[73] Assignee: Winter Beaver, Inc., Olympia, Wash.

[21] Appl. No.: 08/853,332

[22] Filed: May 8, 1997

Related U.S. Application Data

[63] Continuation-in-part of application No. 08/698,427, Aug. 15, 1996, Pat. No. 5,853,263.

[51] Int. Cl.[7] ..... E01C 23/18; E01F 9/06

[52] U.S. Cl. ..... 404/12; 404/13; 404/15; 404/94; 116/63 R

[58] Field of Search ..... 404/9, 12, 13, 404/14, 15, 16, 94, 10; 116/63 R, 63 P

[56] References Cited

U.S. PATENT DOCUMENTS

| | | | |
|---|---|---|---|
| 1,789,525 | 1/1931 | Hoff | 404/15 |
| 2,699,982 | 1/1955 | Batterson | 404/15 |
| 3,332,327 | 7/1967 | Heenan | 94/1.5 |
| 3,478,714 | 11/1969 | Keats . | |
| 3,836,275 | 9/1974 | Finch | 404/13 |
| 4,232,979 | 11/1980 | Johnson, Jr. et al. | 404/16 |
| 4,340,319 | 7/1982 | Johnson, Jr. et al. | 404/16 |
| 4,596,622 | 6/1986 | Heenan et al. | 156/275.5 |
| 5,078,538 | 1/1992 | Montalbano | 404/9 |
| 5,199,814 | 4/1993 | Clark et al. . | |
| 5,310,279 | 5/1994 | Lindner | 404/14 |
| 5,340,231 | 8/1994 | Steere et al. | 404/14 |
| 5,354,143 | 10/1994 | Lindner | 404/9 |
| 5,397,617 | 3/1995 | Chen | 404/9 X |
| 5,425,596 | 6/1995 | Steeree et al. | 404/14 |
| 5,449,244 | 9/1995 | Sandino | 404/14 |
| 5,470,170 | 11/1995 | Lindner | 404/9 |
| 5,529,429 | 6/1996 | Pelegrin | 404/9 |
| 5,662,430 | 9/1997 | Lee | 404/15 |
| 5,667,334 | 9/1997 | Boyce | 404/15 X |
| 5,888,016 | 3/1999 | Ahn | 404/10 |
| 5,908,262 | 6/1999 | Ahn | 404/9 |

FOREIGN PATENT DOCUMENTS

| | | | |
|---|---|---|---|
| 2690468 | 10/1993 | France | 404/9 |

*Primary Examiner*—James A. Lisehora
*Attorney, Agent, or Firm*—Joan H. Pauly

[57] ABSTRACT

A raised road marker has a flat bottom surface with an outer periphery. At least one cavity opens onto the bottom surface laterally inwardly of the periphery and extends upwardly into the marker body. A venting groove extends along the bottom surface from the cavity to the periphery to provide a vent for air trapped in the cavity when the marker is urged into a pool of adhesive to secure the marker to a roadway. The venting of air provides a stronger bond between the marker and adhesive. For markers having a rounded top surface, there is preferably an indexing projection on the top surface and a complementary recess on the bottom surface. This enables interlocking of a plurality of markers in a vertical stack to prevent tilting of the markers.

18 Claims, 8 Drawing Sheets

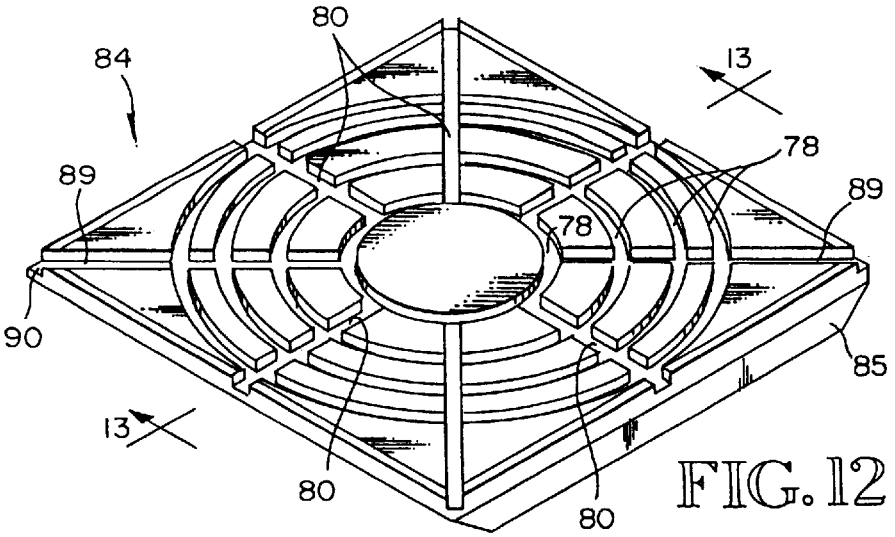
FIG. 12
FIG. 13
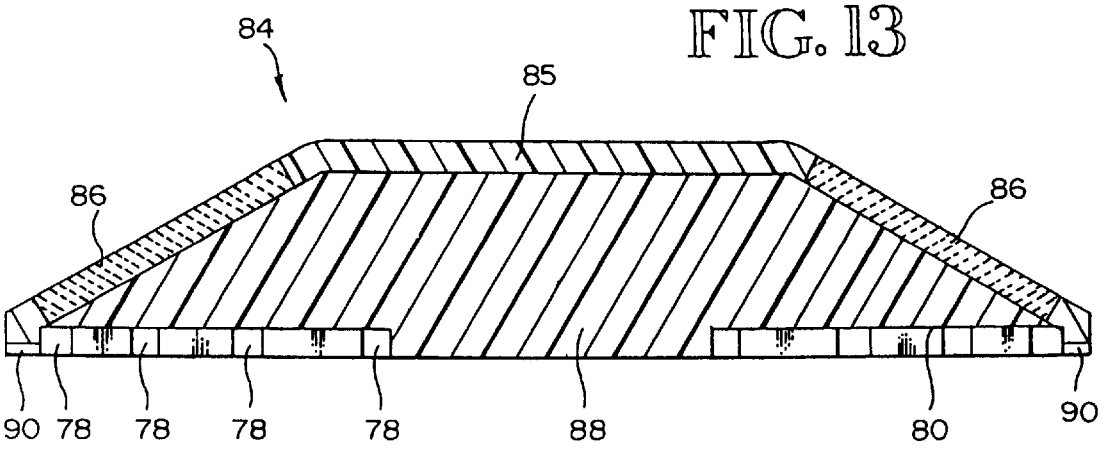

FIG. 16
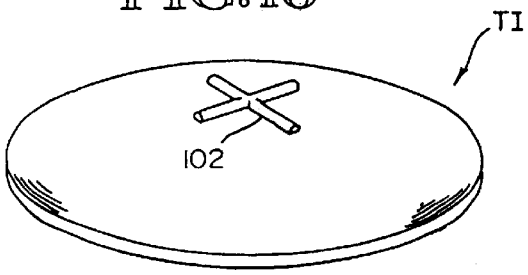
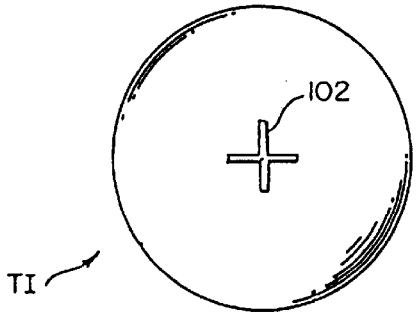
FIG. 17
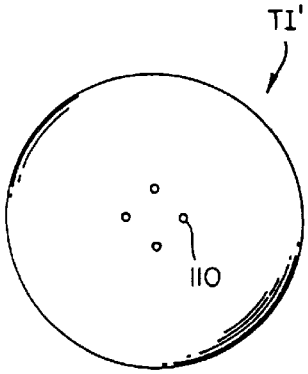
FIG. 19
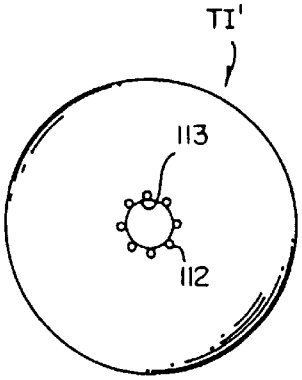
FIG. 20
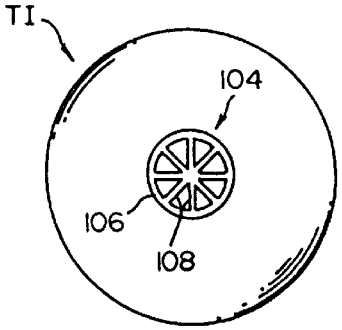
FIG. 18
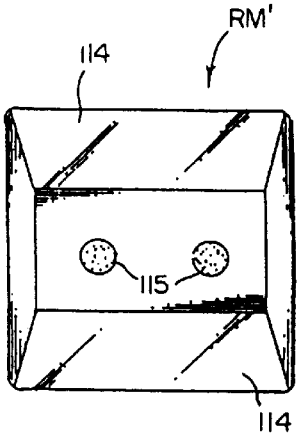
FIG. 21
FIG. 22
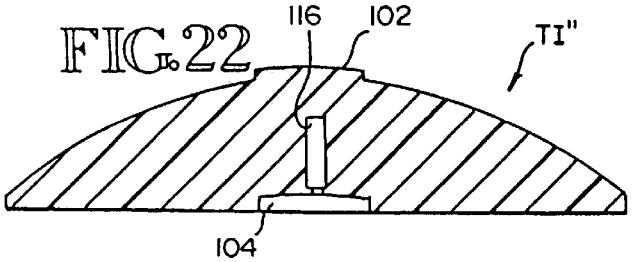
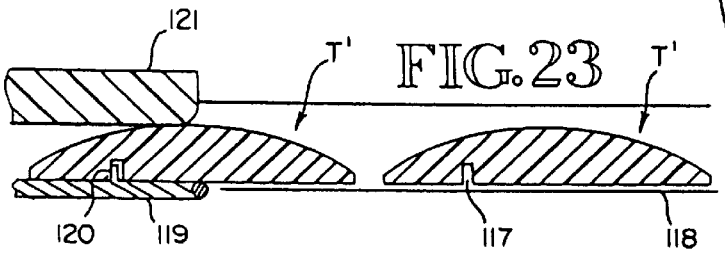
FIG. 23
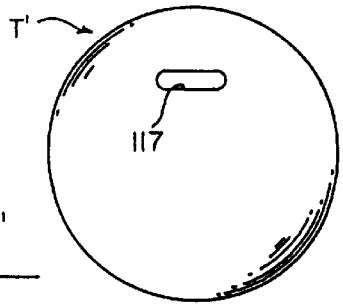
FIG. 24

FIG. 25
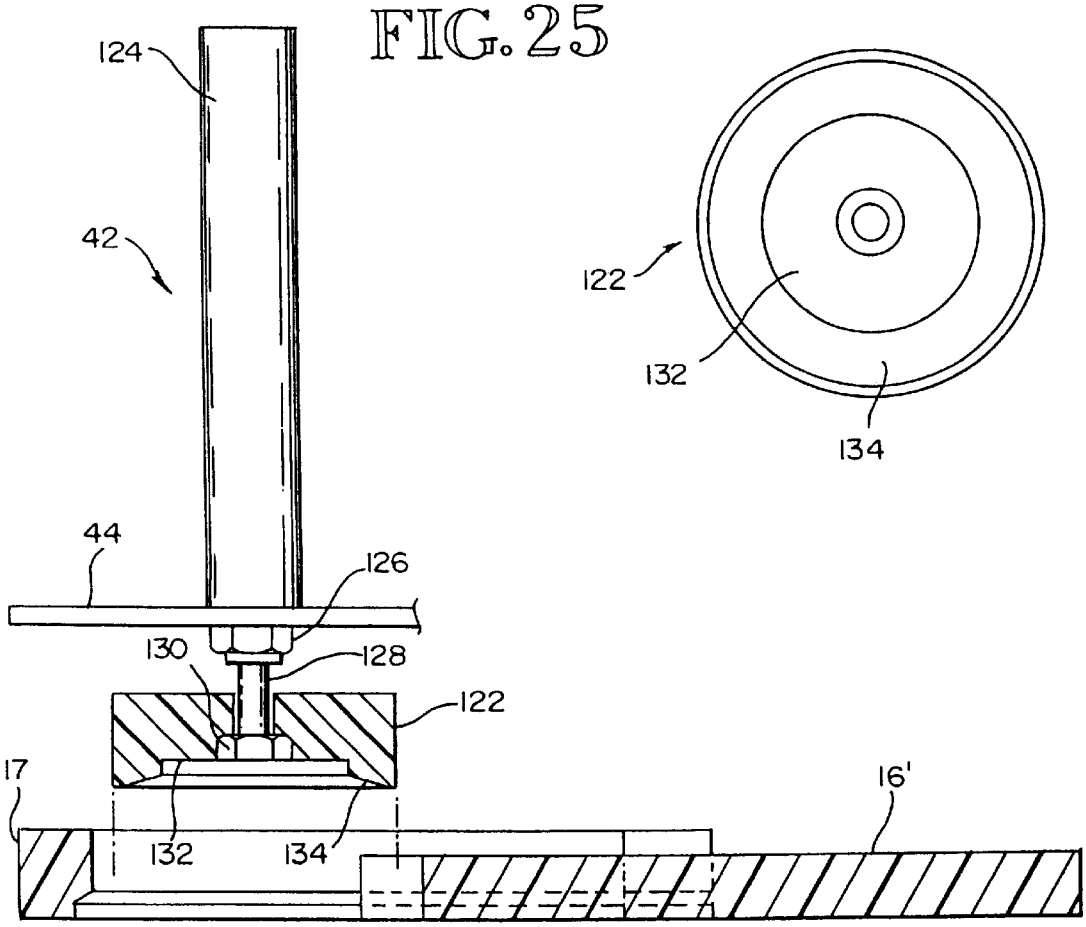
FIG. 26
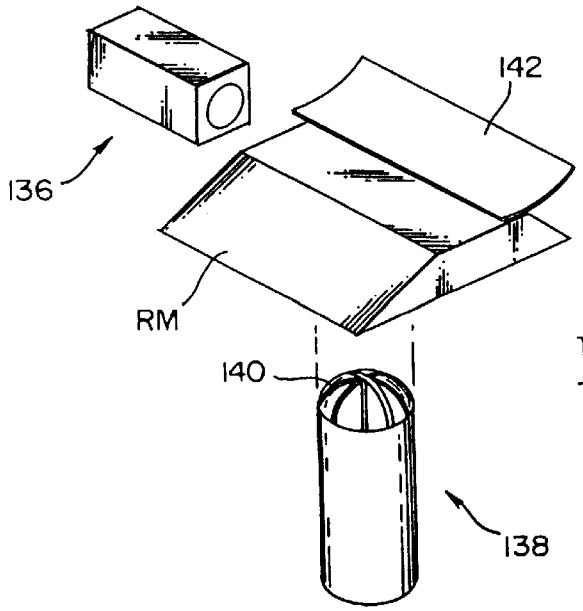
FIG. 27

RAISED ROAD MARKER

RELATED APPLICATION

This application is a continuation-in-part of application Ser. No. 08/698,427, filed Aug. 15, 1996, and entitled "System for Installing Raised Road Markers and Marker for Use in Same", now U.S. Pat. No. 5,853,263.

TECHNICAL FIELD

This invention relates to raised road markers and, more particularly, to a marker having a bottom vent passageway to improve adhesive bonding to a roadway and indexing portions to prevent tilting in a stack of markers.

BACKGROUND INFORMATION

The systems currently in use for installing raised road markers on a roadway have a number of serious drawbacks. These drawbacks include high labor requirements and thus high labor costs, slow speed of installation and consequent low productivity, and especially worker safety concerns. One of the primary sources of concerns for worker safety is the necessity of having a worker stationed in a position relatively exposed to traffic. The installation procedures currently in use are not automated or are incompletely automated. Therefore, a worker is commonly placed in a position adjacent to the roadway to permit the worker to manually place adhesive and/or markers onto the roadway. If, as commonly is the case, the roadway is not closed to traffic, traffic passes in close proximity to the worker. When hot melt adhesives are used, the worker is also subjected to the hazard of handling high temperature materials. In addition, the lack of automation is not conducive to accurate installation of markers because of the vulnerability of the procedures to human error.

The most common type of raised road marker currently in use is a round domed marker with a diameter of about four inches. This type of marker is popularly known as a "turtle". Turtle markers have been in use for a number of years and are usually installed by hand. The basic design of the turtle marker has remain unchanged. The goal of the invention is to provide an improved marker with improved functioning whether installed by hand or by an automated system, and further to provide a marker with improved features specifically adapted to automated systems.

SUMMARY OF THE INVENTION

According to an aspect of the invention, a raised road marker is provided with an indexing feature. The indexed marker comprises a body having a rounded top surface and a flat bottom surface. An indexing projection extends upwardly from the top surface. A complementary recess extends into the bottom surface to receive the projection on an adjacent marker to interlock the markers. The interlocking of the markers prevents tilting of the markers. The projection and the recess are configured to allow adjacent markers to interlock in a plurality of relative circumferential orientations.

The configurations of the indexing projection and complementary recess may be varied. In a first preferred form, the projection has a plurality of equally circumferentially spaced arms. The recess has a plurality of equally circumferentially spaced spokes, at least two spokes for each arm. In a second preferred form, the projection comprises a plurality of equally circumferentially spaced raised dimples, and the recess comprises a plurality of equally circumferentially spaced circular depressions, at least two depressions for each dimple.

According to another aspect of the invention, a raised road marker is provided with a venting groove. The marker comprises a body having a substantially flat bottom surface with an outer periphery. At least one cavity opens onto the bottom surface laterally inwardly of the periphery and extends upwardly into the body. The venting groove extends along the bottom surface from the cavity to the periphery to provide a vent for air trapped in the cavity when the marker is urged onto a pool of adhesive. As used herein, the term "pool of adhesive" refers to a deposit of adhesive on a surface, such as a roadway, for the purpose of securing a road marker to the surface. As is known in the art, such deposits typically cover a surface area slightly larger than the footprint of the marker to be installed and have a thickness sufficient to secure the marker to the surface when the adhesive cures.

The details of the configurations of the cavity and venting groove may be varied. In a first embodiment, the marker comprises a plurality of cavities opening onto the bottom surface laterally inwardly of the periphery and extending upwardly into the body. The cavities are spaced apart. A plurality of connecting grooves extend between adjacent cavities to interconnect the cavities and connect each cavity to the venting groove. This provides a vent for air trapped in each of the cavities. In this embodiment, the venting groove preferably comprises a plurality of spaced groove sections. Each section extends from a different one of the cavities to the outer periphery. Preferably, the groove sections include two pairs of collinear groove sections, with the pairs being substantially perpendicular to each other.

In another embodiment, the venting groove comprises a peripheral groove extending at least substantially all the way around a peripheral portion of the bottom surface. Preferably, the peripheral groove is provided in combination with a cavity arrangement comprising a plurality of radially spaced concentric annular slots and a plurality of radial slots interconnecting the annular slots.

The manner in which the body of the marker is formed may also be varied. One currently preferred method for forming the body of the marker is to mold it as a unitary piece from plastic. This works well for markers, such as the common round turtle marker, that are not required to include reflectors. For markers that do include reflectors, other marker body structures are currently preferred. In such structures, the body comprises an upper outer shell having a reflective outer surface portion, and a lower portion that includes the cavity opening onto the bottom surface. In one embodiment, the lower portion is formed by potting material that fills the shell. The cavity is molded into the potting material. In this embodiment, the venting groove preferably has molded portions molded into the potting material and extends from the molded portions outwardly through peripheral portions of the shell.

In another embodiment, the lower portion includes potting material partially filling the shell, and a bottom member secured to the shell. The cavity is formed in the bottom member. Preferably, the bottom member projects downwardly from the shell, and the venting groove comprises a peripheral groove extending along lower peripheral portions of the shell laterally outwardly of the bottom member. A preferred feature of this embodiment is the provision of a center opening extending vertically through the bottom member. The opening is sized to permit introduction of the potting material into the shell through the opening after the bottom member has been secured to the shell. This allows the bottom member to function, along with the shell, as a mold for the potting material.

A preferred feature of the invention is the dimensioning of the venting groove so that it is sealed when the marker has been urged into the pool of adhesive and air has been vented from the cavity. This can be accomplished by forming the peripheral groove to be sufficiently shallow in a vertical direction, at the outer periphery, to allow the peripheral groove to be sealed. Similarly, when the venting groove comprises a plurality of groove sections, each groove section may be made sufficiently shallow in a vertical direction, at the outer periphery, to allow the groove section to be sealed.

In a currently preferred embodiment of the marker, the marker is provided with both the indexing feature and a venting groove. When the marker has a plurality of cavities, the cavities are preferably positioned around the indexing recess between the recess and the outer periphery. In the case of a cavity arrangement of concentric annular slots connected by radial slots, the annular slots preferably surround the recess.

Another feature of the invention is a molded plastic marker body having an internal cavity configured to receive an electronic component.

The marker of the invention has a number of advantages. The indexing feature makes the marker particularly well-suited for automated or partially automated systems for installing markers on surfaces, such as a roadway. The interlocking of the upper projection on a marker with the lower recess on a second marker above the first allows the markers to be stacked while avoiding tilting of the markers. The avoidance of tilting facilitates positioning of a number of markers to be installed by the system and delivery of individual markers to the various portions of the system. The indexing feature is also useful in orienting a marker having asymmetrical features, such as a reflective surface on one side of the marker.

The venting feature of the marker of the invention improves the performance of installed markers, whether the markers have been installed by hand or by fully or partially automated systems. Prior art markers typically have cavities opening onto a flat bottom surface of the marker in order to facilitate and improve manufacturing procedures and help decrease the cost of the marker. Markers with cavities use less material and therefore tend to be less expensive to produce. The presence of the cavities provides even cooling of a molded marker body so that the molded body holds its shape during manufacture until it has fully cured. The resulting marker accurately retains the desired shape and is stronger than it would be with less even cooling.

With regard to conventional markers, the lower cavities have the unintended and undesirable effect of decreasing the strength of the bond between the marker and adhesive securing the marker to a roadway. Air trapped in the cavities when the marker is installed causes the center portion of the lower surface to adhere poorly. An accomplishment of the invention is the recognition of this problem and the provision of a solution to the problem. The venting groove of the invention allows air trapped in the cavities when the marker is urged into a pool of adhesive to escape from the cavities and exhaust out through the venting groove. As this occurs, the surface resistance of the adhesive pool is overcome and adhesive enters the cavities to fill the void created by the escaping air. The ultimate result is a much stronger adhesive bond in which the entire lower surface is strongly bonded to the adhesive and the adhesive that has moved up into the cavities interlocks the marker with the body of cured adhesive. This provides a highly reliable bond of the marker to the roadway. The increased reliability of the bond decreases the frequency with which markers need to be replaced and thereby helps decrease the overall cost of installing and maintaining markers on a roadway.

The improved bond of the marker to the roadway achieved by the invention results from the cooperative functioning of the cavity and the venting groove. In prior art markers with cavities but no venting groove, the cavities serve to reduce the strength of the bond. The addition of the venting groove not only prevents this negative functioning of the cavity but also allows the cavity to have a positive effect to increase the strength of the bond. Thus, the invention also can achieve improved bonding of markers with designs that previously have not included a bottom cavity. By providing such markers with the combination of the invention, including the bottom cavity and the venting groove, the bonding of the marker is made stronger since the adhesive interlock with the cavity reinforces the adhesive bond to the lower surface.

These and other advantages and features will become apparent from the detailed description of the best modes for carrying out the invention that follows.

BRIEF DESCRIPTION OF THE DRAWINGS

In the drawings, like element designations refer to like parts throughout, and:

FIG. 12 is a pictorial view looking toward the bottom of a third embodiment of the invention.

FIG. 13 is a sectional view taken along the line 13—13 in FIG. 12.

FIG. 16 is a simplified pictorial view of a round marker illustrating a first embodiment of the indexing feature.

FIG. 17 is a top plan view of the marker shown in FIG. 16.

FIG. 18 is a bottom plan view of the marker shown in FIG. 16.

FIGS. 19 and 20 are like FIGS. 17 and 18 except that they show another embodiment of the indexing feature.

FIG. 21 is a top plan view of a modified form of a reflective square marker.

FIG. 22 is a sectional view of a modification of the marker shown in FIGS. 16–18.

FIG. 23 is a sectional view of apparatus for feeding markers to an installation head.

FIG. 24 is a bottom plan view of the marker shown in FIG. 23.

FIG. 25 is a sectional view of installation apparatus including a setting ram, with parts shown in elevation.

FIG. 26 is a bottom plan view of the setting ram head shown in FIG. 25.

FIG. 27 is an exploded pictorial view of orientating apparatus for use with indexed markers.

BEST MODES FOR CARRYING OUT THE INVENTION

Figure 1:
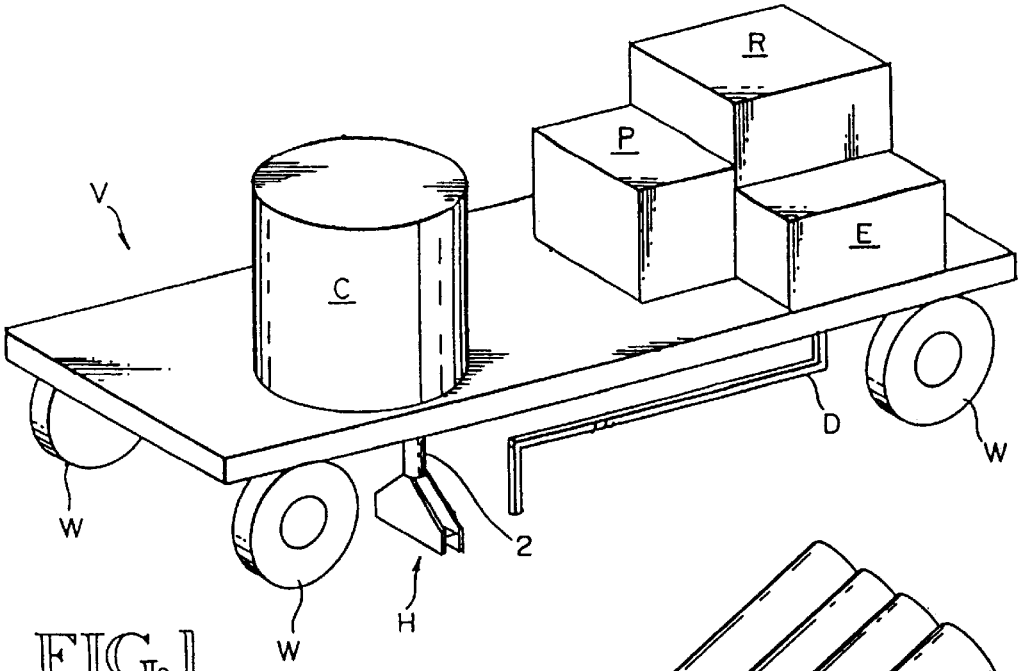
FIG. 1 is a schematic pictorial view of a trailer portion of a vehicle on which elements of automated marker installation apparatus are mounted.
Figure 2:
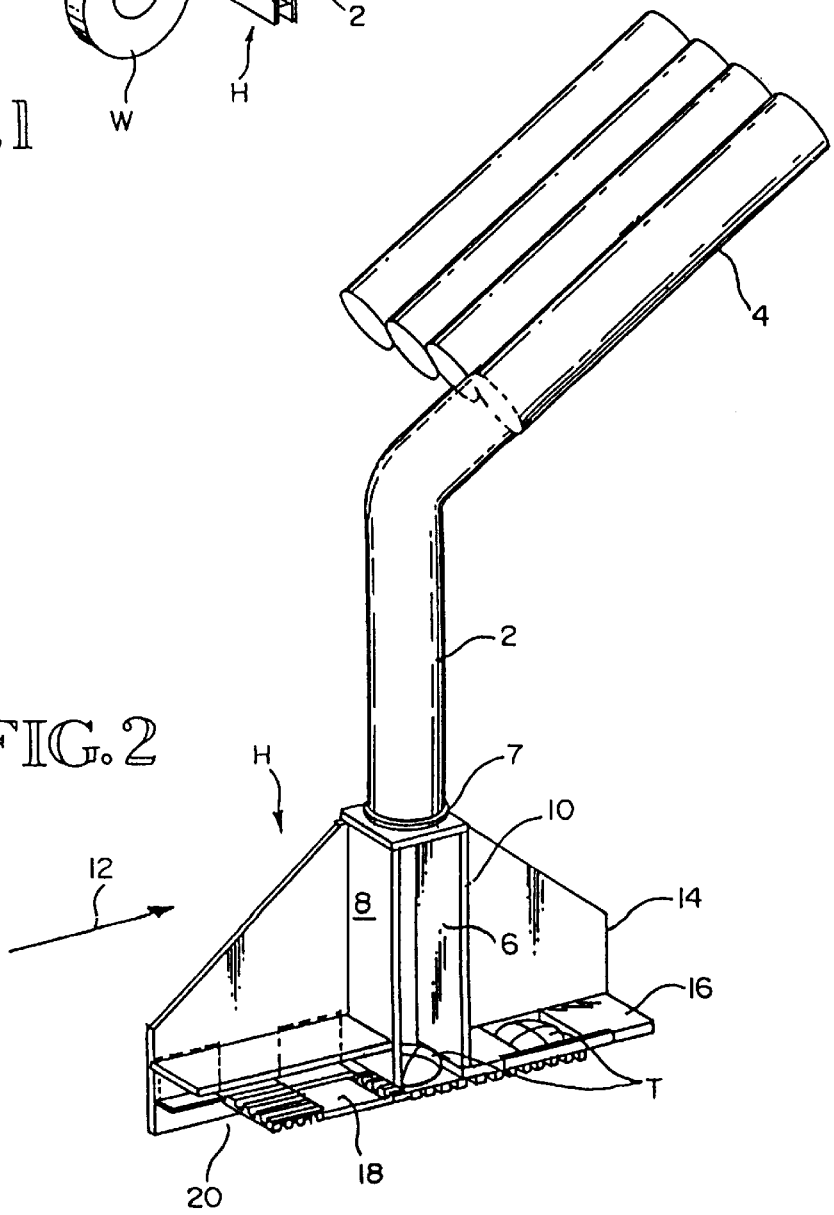
FIG. 2 is a pictorial view of the installation head portion of the apparatus shown in FIG. 1 with foreground portions omitted and upper angled feed tubes added.

The drawings show apparatus for installing raised road markers on a roadway and markers that may be installed using the apparatus. The illustrated markers are constructed according to the invention and also constitute the best modes for carrying out the invention currently known to the applicant. The installation apparatus shown in FIGS. 1 and 2 is described more fully and claimed in my above-cited application Ser. No. 08/698,427. The portions of the disclosure of that application not repeated herein are incorporated herein by reference. As shown herein, the installation apparatus includes a carrousel C for delivering road markers to an installation head H.

FIG. 1 shows the trailer portion V of a vehicle having a bed mounted on wheels W to permit the trailer V to be pulled by a cab portion of the vehicle (not shown). Elements of the apparatus are mounted on and under the trailer bed. These elements include the installation head H, an adhesive reservoir R, and a dispenser or glue tube D. They also include an air compressor P and an electrical unit E for powering the other elements. It is anticipated that the apparatus will be used to install road markers using a hot melt bitumen adhesive. In such case, the reservoir R would be provided with heating means powered by the electrical unit E to maintain the bitumen adhesive at the correct installation temperature. Alternatively, the apparatus could be used in connection with a two-part adhesive, such as the adhesive sold under the trademark "EPOXY". The use of both types of adhesives for installing road markers is known in the art.

FIG. 2 shows the installation head H in more detail. The head H may be used in connection with an entirely vertical feed tube 2, as shown in FIG. 1, or with a modified feed tube having an upper angled section 4, as shown in FIG. 2. The angled section 4 allows the head H to be laterally offset from the trailer bed. Whatever the configuration of the feed tube, road markers are fed downwardly through the vertical tube 2 into a vertical loading chamber 6. The markers may be of various types, such as the round markers T shown in FIG. 2. The markers T are commonly known as "turtles". The chamber 6 is defined by a laterally outer (relative to trailer V) wall 8, a laterally inner wall 10 and opposite laterally extending sidewalls 14. A fitting is provided at the top of the chamber 6 to receive the lower end of the feed tube 2. The fitting 7 shown in FIG. 2 is circular to receive a cylindrical feed tube for round markers T. A square fitting for a square feed tube could also be provided. Such a tube can accommodate either round or square markers.

The installation head has one or more setting stations and preferably has two setting stations. In FIG. 2, the foreground sidewall is omitted to show the portions of the installation head H positioned between the sidewalls 14. The laterally inward direction is indicated in FIG. 2 by the arrow 12. The markers T are moved laterally inwardly and outwardly within the head H by a slide 16 and ultimately to one of two setting stations 18, 20, from which they are set down upon the pavement.

Figure 3:
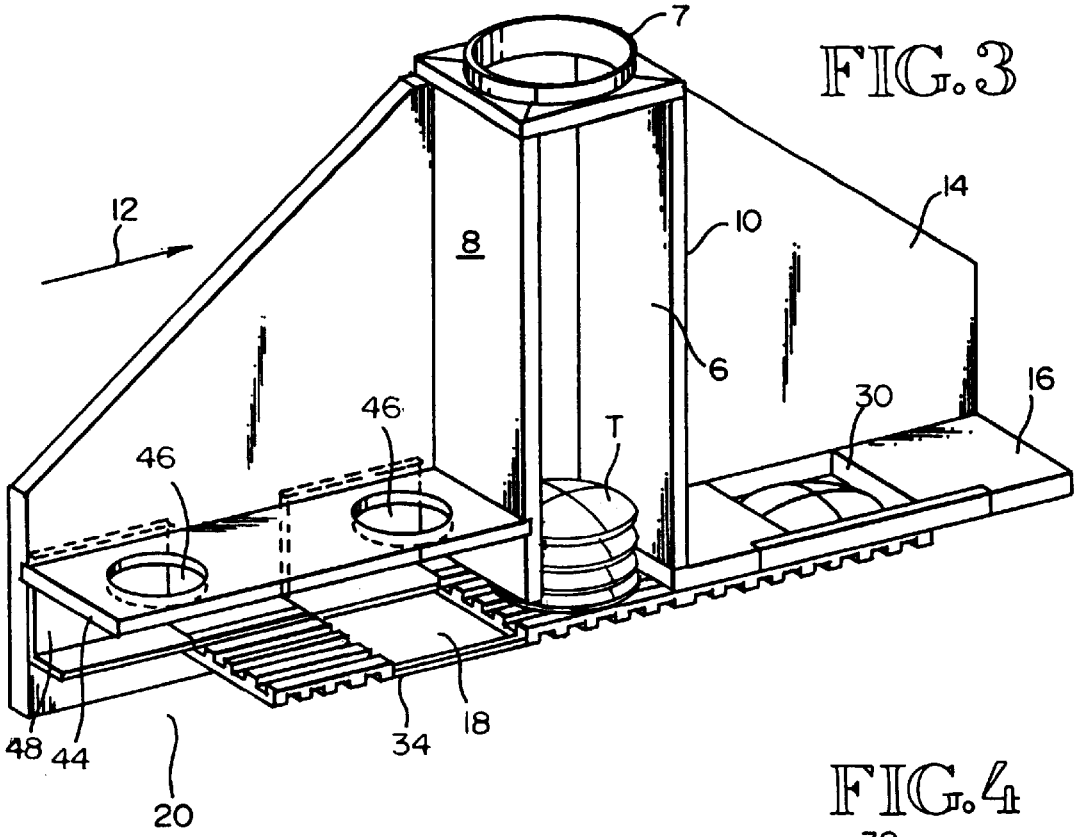
FIG. 3 is an enlarged pictorial view of the installation head shown in FIG. 2.
Figure 4:
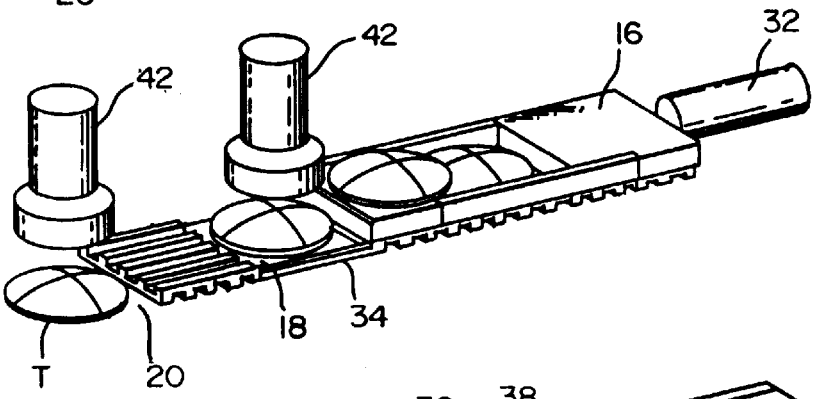
FIG. 4 is a pictorial view of the installation head floor and slide shown in FIG. 3, illustrating the setting rams and slide rams schematically.

FIGS. 3 and 4 show the turtle installation head H in greater detail. In FIG. 3, as in FIG. 2, the foreground sidewall 14 is omitted to reveal inner portions of the head H. Referring to FIG. 3, the head H has two loading stations. The first loading station is defined by the loading chamber walls 8, 10, 14 and is located at the bottom of the loading chamber 6. The second loading station 30 is defined by a vertical opening in the slide 16. The slide 16 is slidably mounted on a horizontal installation head floor 34. Thus, the location of the second loading station 30 is movable. The slide 16 is preferably moved horizontally back and forth along the upper surface of the floor 34 by a ram. FIG. 4 shows one example of a suitable ram 32 positioned endwise of the floor 34 to engage the laterally inner end of the floor. The bottoms of the loading chamber walls 8, 10 are spaced above the floor 34 a distance slightly greater that the height of the markers to allow markers to move along the floor 34, one at a time, under the walls 8, 10, into and out from the loading station at the bottom of the loading chamber 6. The height (vertical thickness) of the slide 16 is substantially equal to the height of the markers to allow the slide 16 to slide under the walls 8, 10. The floor 34 has a vertical opening that defines the first setting station 18.

Figure 5:
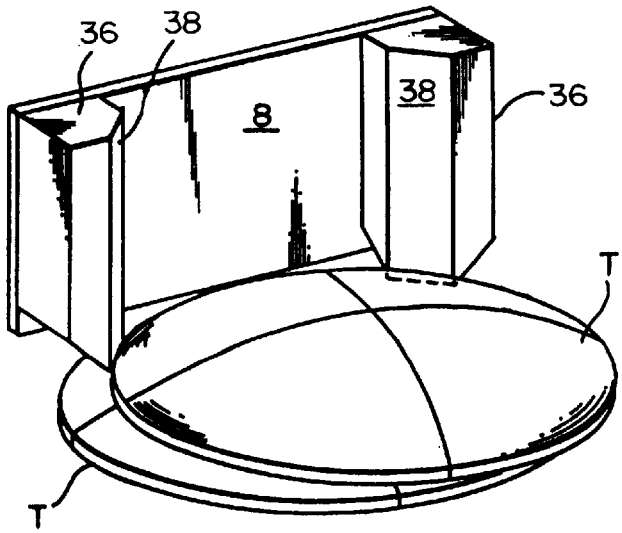
FIG. 5 is a pictorial view of blocking members that may be used in the loading chamber.

FIG. 5 illustrates a preferred feature that helps prevent jamming of the installation head when round markers T are being installed. Referring to FIG. 5, the bottom portion of loading chamber wall 8 may be provided with opposite blocking members 36. Each blocking member 36 has a vertical surface secured to the wall 8. The bottom of the member 36 is spaced a small amount above the bottom of the wall 8. The cross section of the member 36 is in the shape of a square with one corner cut off to form a diagonal vertical surface 38. The diagonal surfaces 38 of the two members 36 are oriented at 90° with respect to each other and 45° with respect to the wall 8. As illustrated in FIG. 5, the height and orientation of the surfaces 38 are such that the surfaces 38 engage a marker T and block its movement when another marker T under the first marker T is pushed out of the loading chamber 6 under the wall 8 by the slide 16. The members 36 prevent the upper marker T from traveling along with the lower marker T and jamming the space under the wall 8. The opposite loading chamber wall 10 may also be provided with a pair of blocking members 36.

A setting ram 42, shown in FIG. 4, is provided at each of the setting stations 18, 20. Referring to FIG. 3, a horizontal mounting wall 44 extends from the outer end of the installation head H to the outer wall 8 of the loading chamber 6, between the sidewalls 14 and above the floor 34. An opening 46 extends vertically through the mounting wall 44 above each of the setting stations 18, 20. The openings 46 are sized to permit the corresponding rams 42 to move downwardly and upwardly through the wall 44 during a setting procedure. Each ram 42 has a housing (not shown) that is secured to the wall 44. At each setting station 18, 20 there is also provided a pair of opposite bomb bay doors 48. In FIG. 3, the door mounted on the omitted foreground sidewall is not shown.

Road markers that are delivered to the bottom of the loading chamber 6 down through the feed tube 2 are moved laterally within the head H by the slide 16. As noted above, the markers are moved laterally to the setting stations 18, 20 from which they are set down onto the pavement by the setting rams 42. When a marker is delivered to one of the setting stations 18, 20, it is maintained at a vertical level flush with the top of the floor 34 by the bomb bay doors 48. The bomb bay doors 48 support the marker until the setting ram 42 is activated to force the marker down through the bomb bay doors 48 and onto the pavement.

Figure 6:
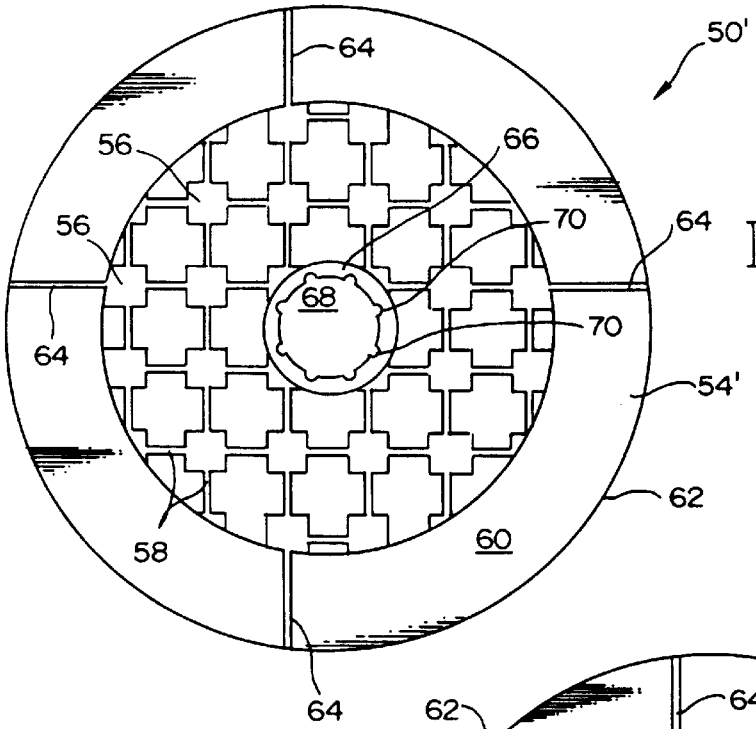
FIG. 6 is a bottom plan view of a round marker incorporating a first embodiment of the invention.
Figure 7:
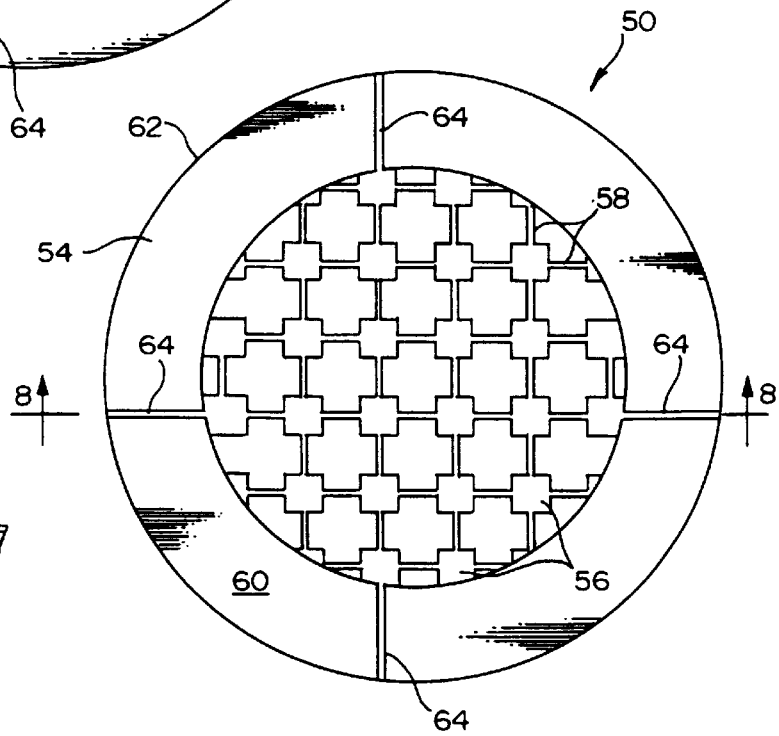
FIG. 7 is like FIG. 6 but omits the indexing feature.
Figure 8:
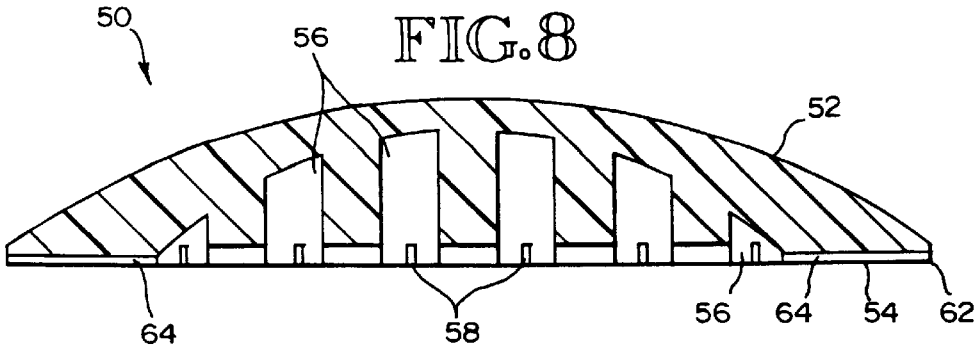
FIG. 8 is a cross-sectional view taken along the line 8—8 in FIG. 7.

FIG. 6 illustrates a first preferred embodiment of the marker 50'. FIGS. 7 and 8 illustrate a modified form of the marker 50' shown in FIG. 6. As shown in FIGS. 7 and 8, the marker 50 lacks the indexing feature. Referring to FIGS. 7 and 8, the marker 50 has a round molded plastic body with a domed, i.e. rounded, top surface 52 and a flat bottom surface 54. In accordance with the invention, the marker 50 includes at least one cavity opening onto the bottom surface laterally inwardly of the outer periphery of the bottom surface. The cavity extends upwardly into the marker body and has the purposes discussed above. The marker 50 shown in FIGS. 7 and 8 has a plurality of cavities 56 arranged in a known checkered pattern. Each of the cavities 56 opens onto the bottom surface 54 laterally inwardly of the periphery 62 of the marker body and extends upwardly into the body. The cavities 56 are spaced apart. A plurality of connecting grooves 58 extend between adjacent cavities 56 to interconnect the cavities 56. As best seen in FIG. 8, the connecting grooves 58 are vertically shallow relative to the cavities 56.

An important feature of the invention is a venting groove that extends along the bottom surface of a raised marker from a laterally inward cavity or cavities to the periphery of the bottom surface. The venting groove provides a vent for air trapped in the cavity or cavities when the marker is urged onto a pool of adhesive. Referring to FIGS. 7 and 8, the venting groove in the embodiment shown therein comprises a plurality of spaced venting groove sections 64. Each section 64 extends from a different one of the cavities 56 to the outer periphery 62. The section 64 extends along a peripheral portion 60 of the bottom surface 54 surrounding the laterally inward portion onto which the cavities 56 open. Each of the cavities 56 has a substantially square cross section and is connected to each adjacent cavity by a connecting groove 58. Each cavity 56 in the center portion of the cavity pattern has four connecting grooves 58 extending therefrom and spaced apart 90°. This same pattern applies to each cavity 58 except those cavities that border on the peripheral portion 60. Each of the bordering cavities 56 has fewer than four connecting grooves 58 associated therewith but has at least one such connecting groove 58. The effect of the pattern is to interconnect all of the cavities 56 and connect each cavity 56 to the venting groove sections 64, to provide a vent for air trapped in each cavity 56.

As shown in FIGS. 7 and 8, the groove sections 64 are preferably arranged in two pairs of collinear groove sections 64. The pairs of grooves 64 are perpendicular to each other. In each pair, each of the two groove sections 64 extends along a common line from a cavity 56 to the peripheral edge 62. This provides a straight pathway for escaping air and helps to maintain a smooth nonturbulent flow of the air. As shown, the groove sections 64 are not evenly spaced around the circumference of the bottom surface 54 but are as evenly spaced as is possible in an arrangement of collinear pairs of venting groove sections and the known checkered cavity pattern. As can be seen in FIG. 8, the cavities 56 are relatively deep to maintain a substantially constant thickness of the marker body between the top surface 52 of the marker 50 and the inner ends of the cavities 56. The connecting grooves 58 have a constant relatively shallow depth, and the venting groove sections 64 are shallower than the connecting grooves 58.

Referring to FIG. 6, the marker 50' shown therein further includes the indexing feature of the invention, described further below. The indexing feature requires that the bottom surface 54' be modified. The bottom surface 54' includes a center flat 66 that is concentric with the bottom surface 54 and interrupts the center portion of the cavity pattern. The central portion of the flat 66 has a depression 68 formed therein. A plurality of circumferentially spaced depressions 70 are formed symmetrically around the perimeter of the central depression 68. When the marker 50' is placed in a stack of markers above another marker, the spaced depressions 70 accommodate complementary projections or "dimples" on the upper surface of the lower marker to interlock the two markers. The curvature of the upper surface of the lower marker is accommodated by the central depression 68.

Figure 9:
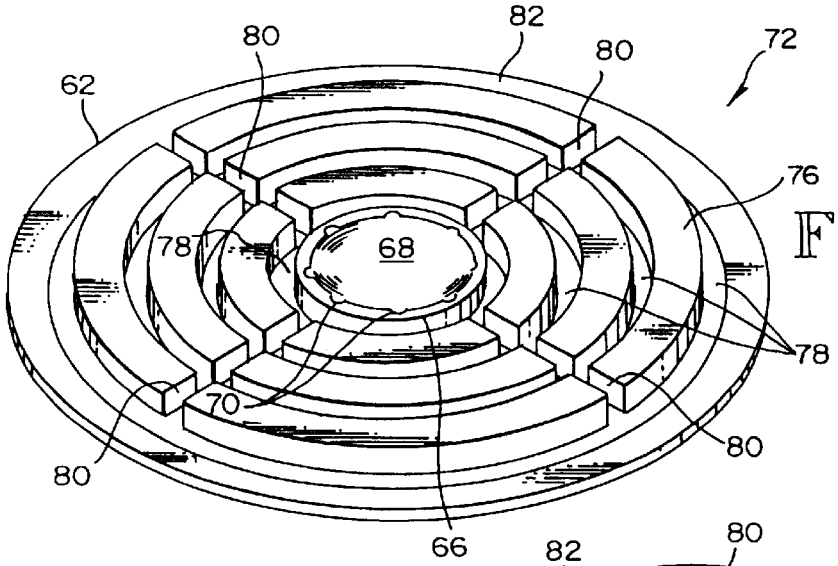
FIG. 9 is a pictorial view looking toward the bottom of a second embodiment of the invention.
Figure 10:
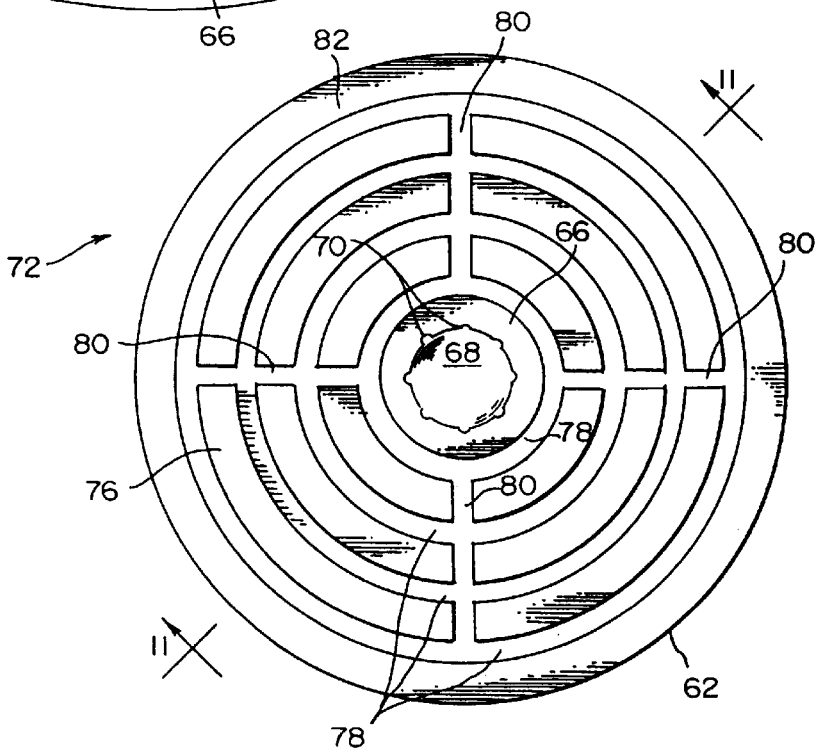
FIG. 10 is a bottom plan view of the marker shown in FIG. 9.
Figure 11:
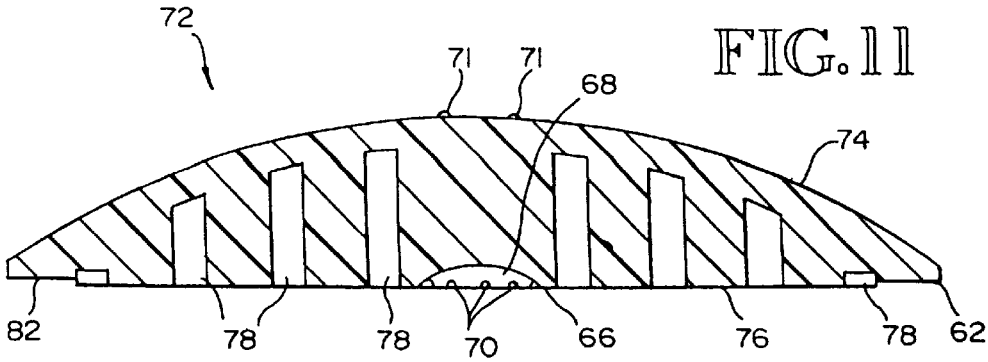
FIG. 11 is a cross-sectional view taken along the line 11—11 in FIG. 10.

FIGS. 9–11 illustrate a second currently preferred embodiment of the marker 72. Referring to FIGS. 9–11, the marker 72 has a domed upper surface 74 and a flat bottom surface 76. The marker 72 differs from the marker 50' shown in FIG. 6 primarily in the cavity arrangement on the bottom surface 76 and the venting groove configuration. In the marker 72, the cavity comprises a plurality of, preferably four, radially spaced concentric annular slots 78. A plurality of radial slots 80 interconnect the annular slots 78. As shown, there are four radial slots 80 spaced around the bottom surface 76 at intervals of 90°. The arrangement of annular and radial slots is the currently preferred configuration of the cavity because it provides greater resistance to shear forces.

The venting groove in the embodiment of FIGS. 9–11 takes the form of a peripheral groove 82 extending all the way around a peripheral portion of the bottom surface 76. The peripheral groove 82 extends radially outwardly from the radially outwardmost annular slot 78 to the outer peripheral edge 62 of the marker body. As can be seen in FIG. 11, the annular slots 78 are progressively shallower moving from the center of the bottom surface 76 toward the periphery. This arrangement is necessary because of the domed configuration of the upper surface 74. The peripheral venting groove 82 is shallower than the outermost annular slot 78, which it surrounds and intersects.

Like the marker 50' shown in FIG. 6, the marker 72 shown in FIGS. 9–11 has an indexing feature. This feature includes the center flat 66, central depression 68, and circumferentially spaced depressions 70 discussed above in connection with FIG. 6. It also includes a plurality of projections or dimples 71 on the top surface of the marker 72. The arrangement and interconnection of the spaced depressions 70 and dimples 71 are discussed further below in connection with FIGS. 19 and 20.

FIGS. 12 and 13 illustrate a third embodiment of the marker 84, which is currently one of the preferred embodiments for reflective markers. The marker 84 has a body that includes an upper plastic outer shell 85 and a lower portion. The shell 85 is hollow, and the flat bottom surface of the marker 84 is formed by the lower portion and includes the cavity opening onto the bottom surface discussed above in connection with the other embodiments. Like most currently known reflective markers, the marker 84 shown in FIGS. 12 and 13 has a square bottom surface with each side having a dimension of about 4 inches. Each side of the shell 85 tapers inwardly as it extends upwardly from its bottom edge. Two opposite tapered sidewalls are formed by reflectors 86. Each reflector 86 is secured to the main portion of the shell 85 in a known manner.

The lower portion of the marker 84 is formed by potting material 88 that fills the hollow shell 85 and is substantially flush with the bottom edge of each of the four sides of the shell 85. The cavity is preferably molded into the potting material 88. Like the embodiment of FIGS. 9–11, in the reflector 84 shown in FIGS. 12 and 13, the cavity is formed by a plurality of annular slots 78 interconnected by radial slots 80.

The venting groove has a molded portion 89 and outer portions 90 that extend through the lower edges of the shell 85. The molded portions 89 are formed by extensions of the radial slots 80 extending from the outermost annular groove 78 to each bottom corner of the shell 85. Like the cavity 78, 80, the extensions 89 are molded into the potting material 88. At each corner, a groove 90 extends through the bottom corner of the shell 85 to communicate the molded portion of the venting groove with the outer periphery of the shell 85, which constitutes the outer periphery of the marker body. A radial slot 80 also extends from the innermost annular slot 78 to a mid-portion of each side. This slot 80 terminates at the outermost annular slot 78, which communicates directly with the outer periphery through an additional groove 90 in the lower edge of the shell 85. The arrangement of a venting groove with molded portions 89 and grooves 90 through the shell edges adapts the annular slot 78/radial slot 80 cavity configuration to the square configuration of the marker 84.

Figure 14:
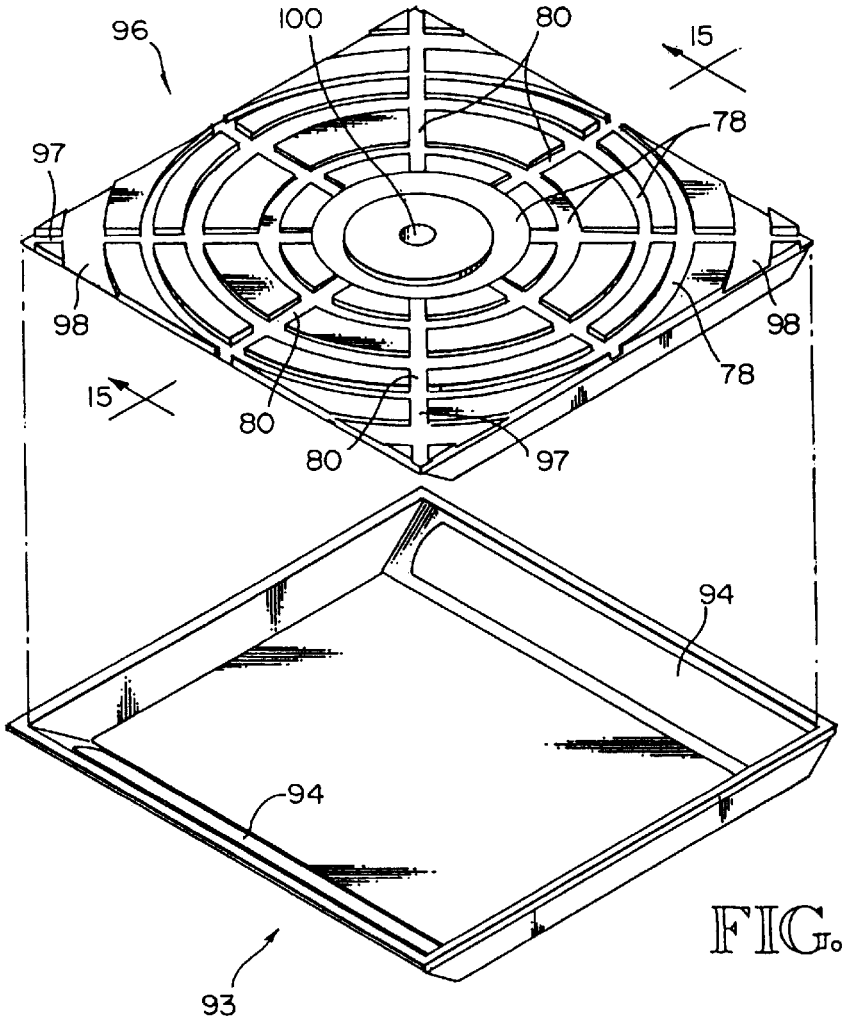
FIG. 14 is an exploded pictorial view of a fourth embodiment of the invention.
Figure 15:
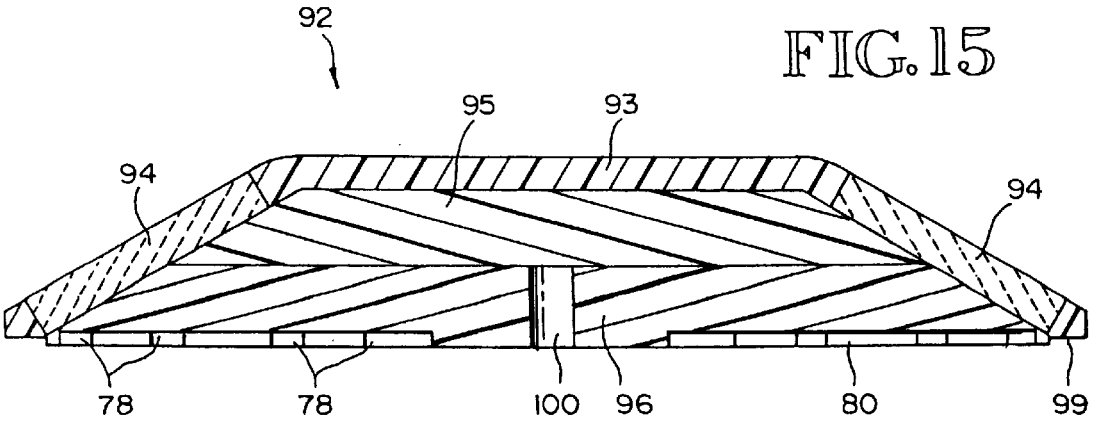
FIG. 15 is a sectional view taken substantially along the line 15—15 in FIG. 14 with potting material added.

FIGS. 14 and 15 show another embodiment of the invention 92 that is a currently preferred embodiment for reflective markers. Like the embodiment of FIGS. 12 and 13, this embodiment 92 has a body that includes a shell 93 with opposite reflectors 94. The shell 93 and reflectors 94 have substantially the same structure as the shell 85 and reflectors 86 shown in FIGS. 12 and 13. Referring to FIGS. 14 and 15, the body of the marker 92 also includes potting material 95 partially filling the shell 93, and a bottom member 96. The lower cavity is formed in the bottom member 96 and has substantially the same structure as the cavity shown in FIGS. 12 and 13. The cavity includes a plurality of annular slots 78 interconnected by radial slots 80 and extensions 97 of the radial slots 80 that extend from the outermost annular slot 78 to the corners of the bottom member 96. It also has the additional feature of an arc-shaped groove 98 formed between each corner and the outermost annular slot 78. This arcuate groove 98 is concentric with the annular slots 78 and is preferably shallower than the slots 78, 80 to form part of the venting groove. Like the outer end of each radial slot 80 or its extension 97, each of the two opposite ends of each arcuates groove 98 opens onto the outer edge of the bottom member 96. FIG. 15 shows the marker 92 in a fully assembled condition.

Referring to FIG. 15, the bottom member 96 projects downwardly and outwardly from the shell 85 a small distance which, with the adjacent bottom edge of the shell 93, defines an outer peripheral groove 99. The arcuate grooves 98 and peripheral groove 99 form the venting groove in this embodiment. The peripheral groove 99 extends all the way around the body of the marker 92 along each of its four sides laterally outwardly of the bottom member 96.

The embodiment of FIGS. 14 and 15 may be formed by first partially filling the hollow shell 93 with potting material 95 and then securing the bottom member 96 to the shell 93. However, it is preferable to first secure the bottom member 96 to the shell 93 and then to introduce a potting material into the space formed between the upper portion of the shell 93 and the top of the bottom member 96. For this purpose, the bottom member 96 is preferably provided with a center opening 100 extending vertically therethrough. The opening 100 is sized to permit introduction of potting material 95 into the shell 93 through the opening 100 after the bottom member 96 has been secured to the shell 93. This procedure helps ensure that the space inside the shell 93 is completely filled but is no overfilled so that the bottom member 96 is correctly positioned relative to the shell 93. In effect, when the potting material 95 is injected through the opening 100, the shell 93 and bottom member 96 cooperate to act as a mold for the potting material 95. Whether the bottom member 96 is secured to the shell 93 before or after the potting material is introduced into the shell 93, the manner in which the bottom member 96 is secured may be varied. Currently, the preferred method is fusing the bottom member 96 by plastic welding.

In square reflective markers currently in use, the marker typically has an upper shell filled with a potting material. Sand is added to the potting material to create a rough bottom surface and thereby improve the adhesive bond to the bottom surface. Such a rough surface is undesirable in the type of automated system illustrated and described herein. The rough surface tends to create excessive wear on portions of the apparatus along which the marker is moved. In markers constructed according to the invention, such as those shown in FIGS. 12–15, this problem can be avoided by omitting the sand and thereby making the unbroken portions of the bottom surface smooth. This can be done without sacrificing the strength of the bond since the combination of the lower cavity and the venting groove provides much greater strengthening of the bond than roughening of the surface can accomplish. In addition, the smoothness of the bottom surface can be decreased without making the surface abrasive by shot peening the surface to create microscopic adhesive bond sites.

Whatever the particular configuration of the venting groove, it is preferable that it be sufficiently shallow to be sealed by adhesive onto which the marker has been urged to install the marker on a roadway. More specifically, the venting groove is preferably sufficiently shallow in a vertical direction, at the outer periphery 62 of the marker, to allow the venting groove to be sealed by the adhesive when the marker has been urged into the adhesive and air has been vented from the cavity or cavities through the venting groove. For example, when the venting groove includes a plurality of groove sections, such as those shown in FIGS. 6–8 or 12–13, each groove section 64, 90 preferably has the necessary degree of shallowness at the outer periphery 62 to allow the groove section 64, 90 to be sealed by the adhesive. In the case of a peripheral groove, such as that shown in FIGS. 9–11 or 14–15, the peripheral groove 82, 99 preferably is sufficiently shallow to be sealed around its entire circumferential extent. The peripheral grooves 82, 99 illustrated in FIGS. 9–11 and 14–15 also maintain the shallowness across their radial extent.

The required shallowness may vary somewhat with the type of adhesive being used and the specifications of a particular road construction. At present, a deposit of adhesive placed on a roadway to bond a raised road marker thereto is typically about ¼ inch thick. When a marker is urged down into the adhesive to bond it to the roadway, it typically penetrates the pool of adhesive about ⅛ inch. In the currently preferred embodiments of the marker, the venting groove is about 1/16 inch or less at the outer periphery 62. It is anticipated that a venting groove with this dimension will be suitably sealed whatever type of adhesive or installation procedure is used. As is known in the art, the sealing of the edges of a raised marker is desirable with or without the presence of a venting groove in order to avoid the accumulation of moisture, dirt, and other contamination between the marker and the roadway.

The functioning of the cavity/venting groove combination during the installation of markers constructed according to the invention will be discussed in connection with the operation of the installation system shown and described herein. An initial step of the operation is the ejection of heated bitumen adhesive onto the road surface from the glue tube D at the position where the marker is to be laid. When the adhesive has been deposited, a marker is forced downwardly out from the installation head H by a setting ram 42. The action of the ram 42 forces the marker down into the pool of adhesive. During the brief time, approximately one-half of a second, between the depositing of the pool of adhesive and the forceful ejection of the marker, the upper and lower surfaces of the pool of adhesive begin to cool. This increases the surface tension of the adhesive and thereby its resistance to movement up into the cavity and adherence to the cavity sidewalls. However, the venting groove allows the air that would otherwise be trapped inside the cavity to exhaust out through the venting groove.

The air moves out of the cavity through the venting groove and the hot, still liquid center of the adhesive pool to vent to atmosphere. The venting of the air causes the adhesive to enter the cavity. This process is enhanced by the relative shallowness of the venting groove at the periphery of the marker. In FIGS. 6–8 and 12–13, the outer grooves 64, 90 are shallower than the cavity portions with which they communicate. Similarly, the peripheral grooves 82, 99 shown in FIGS. 9–11 and 14–15 are shallower than the cavity and/or venting groove portions with which they communicate. The relative shallowness of the venting groove at the outer periphery increases the velocity of the air exhausted from the venting groove.

The adhesive adheres to the flat bottom surface between the cavity portions and to the inner sidewalls of the cavity. To maximize the adhesion, it is preferable that the flat unbroken portions of the bottom surface and at least lower portions of the cavity sidewalls be treated to provide increased bond sites. This is preferably done by shot peening. To facilitate the shot peening procedure, the cavity sidewalls may be sloped inwardly as they extend upwardly. For example, a slope of about 5° is currently regarded as suitable.

Preferably, following setting down of the marker by the setting ram 42, a setting wheel (not shown) rides over the top of the marker to push the marker further down into the adhesive. This creates a vacuum in the venting groove as the setting wheel moves off the marker and there is a resulting slight upward movement of the marker. The suction causes liquid adhesive at the center of the pool of adhesive to enter the venting groove to completely fill and seal the venting groove. Even without the use of a setting wheel, the dimensioning of the venting groove is chosen so that it will seal when the marker is forced down onto the pool of adhesive and air is vented from the cavity, as discussed above. However, the use of the setting wheel increases the completeness of the filling and sealing of the venting groove and provides further assurance that the entire periphery of the marker will be sealed against contaminants accumulating between the marker and the roadway.

FIGS. 16–20 illustrate two embodiments of the indexing feature of the invention. In these figures, the lower cavity and venting groove arrangement is omitted to simplify illustration of the indexing feature. Like the markers 50, 50', 72 shown in FIGS. 6–11 and described above, the markers TI and TI' shown in FIGS. 16–20 have the same basic shape as a conventional turtle T. This shape is modified by the indexing portions of the markers TI, TI'.

Referring to FIGS. 16 and 17, the center portion of the rounded upper surface of the marker TI shown in FIGS. 16–18 includes a cross-shaped projection 102. The projection 102 has four arms that are equal in length and equally circumferentially spaced. The center of the cross coincidences with the center of the upper surface of the marker TI. The flat lower surface of the marker TI is shown in FIG. 18. It includes a depression 104 complementary to the upper raised portion 102 for receiving the raised portion 102 of an adjacent marker TI. The depression 104 includes an outer annular portion 106 and eight radially extending and equally circumferentially spaced spokes 108 extending from the center to the outer annular portion 106. The depression 104 generally conforms to the curvature of the upper surface of the marker TI to receive the upper surface and accommodate the raised portion 102 in the depression 104. Since the depression 104 has eight spokes 108, when a second marker TI is dropped down onto a first marker TI, each of the arms of the raised portion 102 will readily be received into one of the depression spokes 108 with any small additional movement of the upper marker TI. Such additional movement is a natural occurrence in most stacking operations.

When the indexed markers TI are used in a feed tube or other apparatus in which the markers are stacked, the interlocking of the raised portions 102 and depressions 104 prevents the markers TI from tilting in the tube. The avoidance of tilting of the markers TI prevents jamming of the markers TI in the tube and incorrect orientation of the markers TI when they reach the loading station at the bottom of the tube. The interlocking of the indexing portions 102, 104 does not interfere with the movement of a marker TI out of a loading station at the bottom of a loading chamber 6 since the curvature of the upper surface of the marker TI allows the bottom marker TI to slide easily out from under the stack of markers TI.

It is anticipated that, in most applications, only a single type of marker will be used in any particular feed tube. However, if it is desired, round and square markers may be mixed in a single feed tube or other feeding apparatus. For this purpose, the square markers to be used in such a system preferably have on their lower surfaces a depression 104 of the type shown in FIG. 18. Complementary projections 102 on the flat upper surfaces of the square markers may also be provided. This would prevent rotation of the round markers in a mixed stack.

FIGS. 19 and 20 show another form of the indexed marker TI'. Like the marker TI shown in FIGS. 16–18, the marker TI' has a projection and a recess configured to allow adjacent markers to interlock in a plurality of relative circumferential orientations. The projection comprises four equally circumferentially spaced raised dimples 110 arranged in a circle concentric with the upper surface of the marker TI'. The recess comprises eight equally circumferentially spaced circular depressions 112, two depressions 112 for each dimple 110. The circular area 114 defined by the depressions 112 forms a central depression 114 to accommodate the curved upper surface of the marker TI'. FIGS. 6 and 9–11 illustrate a similar arrangement of dimples 71 and depressions 70.

FIGS. 21 and 22 illustrate additional features for specialized marker applications. Referring to FIG. 21, a square marker RM' has two opposite reflective surfaces 116 and two solar cells 118 on its flat upper surface. The solar cells 118 can be used for powering a flasher implanted in the marker RM' or a transmitter for transmitting a signal from the marker RM'. Such a transmitter might be used, for example, to transmit traffic flow information to a central location. Another use would be to transmit accident location information once the marker transmitter is triggered by a law enforcement official. One of the solar cells 118 may be replaced by a receiver for receiving a signal from a law enforcement official to begin flashing or transmitting. FIG. 22 illustrates a modified round indexed marker TI". This marker TI" has the same outer configuration shown in FIGS. 16–18 and the additional feature of an internal cavity 120. This internal cavity 120 provides a place for a microchip embedded in the marker to control transmitting and/or recording functions. A similar cavity would be provided in a square marker having such functions. With the development of sensor and information systems technology, it is anticipated that a wide range of additional uses for the solar cell and microchip features of the specialized markers will be developed.

FIGS. 23 and 24 show another modified marker T' that may be used in an automated marker installation system. The marker T' has an engagement slot 117 opening onto its bottom surface. The marker T' may be fed down to an installation head through a feed tube having a lower horizontal run 118. The feeding of the markers T' down to the point shown in FIG. 23 may be accomplished under the action of gravity and/or the action of the markers pushing each other along. A conveyor 119 is positioned at the end of the lower run 118. When a marker T' reaches the conveyor 119, an engagement pin 120 carried by the conveyor 119 is received into the slot 117 in the bottom of the marker T'. A spring loaded upper member 121 is provided above the conveyor 119 to push down on the upper surface of the marker T' and maintain the pin 120 in the slot 117. The conveyor 119 moves the marker T' into the loading chamber of the installation head. In order to maintain the markers in correct rotational orientation for engagement by the pins 120, a thin web of material may be provided connecting a line of markers T' together. The conveyor 119 preferably has a plurality of pins 120 for engaging a plurality of markers T'. The marker T' preferably includes the indexing feature and/or the venting groove feature described above. Both features are omitted in FIGS. 23 and 24 to simplify the illustration of the engagement feature.

FIGS. 25 and 26 illustrate a ram head 122 designed for use with conventional round turtle markers T and round markers constructed in accordance with the invention. FIG. 25 also illustrates a modified slide 16' that cooperates with a stop member 17 to hold a round marker T in a horizontal position and prevent the marker T from tilting or wobbling when it is engaged by a setting ram 42. As shown in FIG. 25, the ram 42 has a cylinder housing 124 secured to the mounting wall 44 by a nut 126. A piston rod 128 slidably extends out through the lower end of the cylinder housing 124 through the corresponding opening 46 in the mounting wall 44. The ram head 122 is attached to the outer end of the piston rod 128 by a nut 130. The head 122 has a generally cylindrical or disk-like configuration with a downwardly facing recess 132, 134. The inner portion 132 of the recess has a cylindrical sidewall. The outer portion 134 of the recess has a beveled sidewall that tapers radially outwardly and downwardly from the bottom edge of the inner portion sidewall. The beveling of the outer recess portion 134 is configured to engage the rounded upper surface of a turtle T. The inner recess portion 132 provides space for the center top portion of the turtle T and, if applicable, the indexing projections thereon. When the ram 42 is activated, the piston rod 128 moves downwardly to move the head 122 downwardly against the turtle T engaged in the stop member 17 by the slide 16'. The force of the head 122 against the turtle T forces the turtle T downwardly and the bomb bay doors 48 outwardly to allow downward passage of the turtle T. The ram 42 forces the turtle T down onto a pool of adhesive dispensed from the glue tube D with sufficient force to set the turtle T into the adhesive. The diameter of the head 122 is chosen to permit the head 122 to move between the bomb bay doors 48 even when the doors 48 are in their closed position.

In an automated system for installing markers on a roadway, it may be necessary to ensure that markers are correctly oriented as they move through the system. For example, it may be necessary to ensure that a reflective surface 116 of each square marker RM is in the correct orientation for its installation on the pavement. FIG. 27 shows schematically an example of a sensing and orienting mechanism that may be used in an automated system. An optical sensor 136 shines a light on an adjacent face of the marker RM and detects light reflected back from the reflective surface 116. If the reflective surface 116 is not in the correct position adjacent to the sensor 136, a pivot shaft 138 is raised into engagement with the marker RM. The upper radial surface of the shaft 138 has a pattern of projections 140 complementary to the depression pattern shown in FIG. 18. The underside of marker RM has a depression with the configuration shown in FIG. 18. Thus, the projection 140 on top of the shaft 138 interlocks with the bottom of the marker RM. A spring 142 presses down on the top of the marker RM to ensure its proper engagement with the pivot shaft 138. The shaft 138 pivots to pivot the marker RM until the sensor 136 detects the correct orientation of the reflective surface 116.

Although the preferred embodiments of the invention have been illustrated and described herein, it is intended to be understood that various modifications and omissions in form and detail may be made without departing from the spirit and scope of the invention as defined by the following claims.

What is claimed is:

1. A raised road marker comprising a fixed-form body having a rounded top surface, a flat bottom surface, an indexing projection extending upwardly from said top surface, and a complementary recess extending into said bottom surface to receive said projection of an adjacent marker to interlock the markers and prevent tilting of the markers; said projection and said recess being configured to allow adjacent markers to interlock in a plurality of relative circumferential orientations.

2. A raised road marker comprising a body having a rounded top surface, a flat bottom surface, an indexing projection extending upwardly from said top surface, and a complementary recess extending into said bottom surface to receive said projection of an adjacent marker to interlock the markers and prevent tilting of the markers; said projection and said recess being configured to allow adjacent markers to interlock in a plurality of relative circumferential orientations;

in which said projection has a plurality of equally circumferentially spaced radial arms, and said recess has a plurality of equally circumferentially spaced radial spokes, at least two spokes for each said arm.

3. A raised road marker comprising a body having a rounded top surface, a flat bottom surface, an indexing projection extending upwardly from said top surface, and a complementary recess extending into said bottom surface to receive said projection of an adjacent marker to interlock the markers and prevent tilting of the markers; said projection and said recess being configured to allow adjacent markers to interlock in a plurality of relative circumferential orientations;

in which said projection comprises a plurality of equally circumferentially spaced raised dimples, and said recess comprises a plurality of equally circumferentially spaced circular depressions, at least two depressions for each dimple.

4. A raised road marker comprising a body having a top surface, a substantially flat bottom surface with an outer periphery, at least one cavity opening onto said bottom surface laterally inwardly of said periphery and extending upwardly into said body, and a venting groove extending along said bottom surface from said cavity to said periphery to provide a vent for air trapped in said cavity when the marker is urged onto a pool of adhesive;

wherein said venting groove comprises a peripheral groove extending at least substantially all the way around a peripheral portion of said bottom surface, said peripheral groove being shallower than said cavity; and wherein said cavity and said venting groove open onto said bottom surface but are closed to communication with said top surface.

5. A raised road marker comprising a body having a top surface, a substantially flat bottom surface with an outer periphery, at least one cavity opening onto said bottom surface laterally inwardly of said periphery and extending upwardly into said body, and a venting groove extending along said bottom surface from said cavity to said periphery to provide a vent for air trapped in said cavity when the marker is urged onto a pool of adhesive;

wherein, at said periphery, said venting groove is shallower than said cavity and is sufficiently shallow to allow said venting groove to be sealed by said adhesive when the marker has been urged onto said pool of adhesive and air has been vented from said cavity;

wherein said cavity comprises a plurality of radially spaced concentric annular slots, and a plurality of radial slots interconnecting said annular slots and communicating at least substantially every portion of said annular slots with said venting groove; and wherein, prior to the marker being urged onto said pool of adhesive, said cavity and said venting groove open onto said bottom surface and said outer periphery thereof but are otherwise closed to communication with atmosphere.

6. A raised road marker comprising a body having a substantially flat bottom surface with an outer periphery, at least one cavity opening onto said bottom surface laterally inwardly of said periphery and extending upwardly into said body, and a venting groove extending along said bottom surface from said cavity to said periphery to provide a vent for air trapped in said cavity when the marker is urged onto a pool of adhesive;

wherein said cavity comprises a plurality of radially spaced concentric annular slots, and a plurality of radial slots interconnecting said annular slots and communicating at least substantially every portion of said annular slots with said venting groove; and wherein said venting groove comprises a peripheral groove extending at least substantially all the way around a peripheral portion of said bottom surface.

7. The marker of claim 6, wherein, at said outer periphery, said peripheral groove is sufficiently shallow in a vertical direction to allow said peripheral groove to be sealed by said adhesive when the marker has been urged into said pool of adhesive and air has been vented from said cavity.

8. A raised road marker comprising a body having a top surface, a substantially flat bottom surface with an outer periphery, at least one cavity opening onto said bottom surface laterally inwardly of said periphery and extending upwardly into said body, and a venting groove extending along said bottom surface from said cavity to said periphery to provide a vent for air trapped in said cavity when the marker is urged onto a pool of adhesive;

wherein said venting groove comprises a peripheral groove extending at least substantially all the way around a peripheral portion of said bottom surface;

wherein, at said outer periphery, said peripheral groove is sufficiently shallow in a vertical direction to allow said peripheral groove to be sealed by said adhesive when the marker has been urged into said pool of adhesive and air has been vented from said cavity; and wherein said cavity and said venting groove open onto said bottom surface but are closed to communication with said top surface.

9. A raised road marker comprising a body having a substantially flat bottom surface with an outer periphery, at least one cavity opening onto said bottom surface laterally inwardly of said periphery and extending upwardly into said body, and a venting groove extending along said bottom surface from said cavity to said periphery to provide a vent for air trapped in said cavity when the marker is urged onto a pool of adhesive;

wherein said body comprises an upper outer shell having a reflective outer surface portion, and a lower portion that includes said cavity;

wherein said lower portion is formed by potting material that fills said shell, said cavity being molded into said potting material; and wherein said venting groove has molded portions molded into said potting material and extends from said molded portions outwardly through peripheral portions of said shell.

10. The marker of claim 9, wherein, at said outer periphery, said venting groove is sufficiently shallow in a vertical direction to allow said venting groove to be sealed by said adhesive when the marker has been urged into said pool of adhesive and air has been vented from said cavity.

11. A raised road marker comprising a body having a substantially flat bottom surface with an outer periphery, at least one cavity opening onto said bottom surface laterally inwardly of said periphery and extending upwardly into said body, and a venting groove extending along said bottom surface from said cavity to said periphery to provide a vent for air trapped in said cavity when the marker is urged onto a pool of adhesive;

wherein said body comprises an upper outer shell having a reflective outer surface portion, and a lower portion that includes said cavity; and wherein, in an assembled condition of the marker prior to installation of the marker onto a pool of adhesive on a road surface, said lower portion includes potting material partially filling said shell, and a bottom member secured to said shell; said cavity being formed in said bottom member.

12. The marker of claim 11, wherein said bottom member has a center opening extending vertically therethrough sized to permit introduction of said potting material into said shell through said opening after said bottom member has been secured to said shell.

13. A raised road marker comprising a body having a substantially flat bottom surface with an outer periphery, at least one cavity opening onto said bottom surface laterally inwardly of said periphery and extending upwardly into said body, and a venting groove extending along said bottom surface from said cavity to said periphery to provide a vent for air trapped in said cavity when the marker is urged onto a pool of adhesive;

wherein said body comprises an upper outer shell having a reflective outer surface portion, and a lower portion that includes said cavity;

wherein said lower portion includes potting material partially filling said shell, and a bottom member secured to said shell; said cavity being formed in said bottom member; and wherein said bottom member projects downwardly from said shell, and said venting groove comprises a peripheral groove extending along lower peripheral portions of said shell laterally outwardly of said bottom member.

14. The marker of claim 13, wherein, at said outer periphery, said venting groove is sufficiently shallow in a vertical direction to allow said venting groove to be sealed by said adhesive when the marker has been urged into said pool of adhesive and air has been vented from said cavity.

15. The marker of claim 13, wherein said bottom member has a center opening extending vertically therethrough sized to permit introduction of said potting material into said shell through said opening after said bottom member has been secured to said shell.

16. A raised road marker comprising a body having a substantially flat bottom surface with an outer periphery, at least one cavity opening onto said bottom surface laterally inwardly of said periphery and extending upwardly into said body, and a venting groove extending along said bottom surface from said cavity to said periphery to provide a vent for air trapped in said cavity when the marker is urged onto a pool of adhesive;

wherein said body has a fixed form and comprises a rounded top surface, an indexing projection extending upwardly from said top surface, and a complementary recess extending into said bottom surface to receive said projection of an adjacent marker to interlock the markers and prevent tilting of the markers; said projection and said recess being configured to allow adjacent markers to interlock in a plurality of relative circumferential orientations.

17. A raised road marker comprising a body having a substantially flat bottom surface with an outer periphery, at least one cavity opening onto said bottom surface laterally inwardly of said periphery and extending upwardly into said body, and a venting groove extending along said bottom surface from said cavity to said periphery to provide a vent for air trapped in said cavity when the marker is urged onto a pool of adhesive;

wherein a plurality of said cavities open onto said bottom surface laterally inwardly of said periphery and extend upwardly into said body, said cavities being spaced apart, and a plurality of connecting grooves extend between adjacent cavities to interconnect said cavities and connect each said cavity to said venting groove, to provide a vent for air trapped in each said cavity; and wherein said body comprises a rounded top surface, an indexing projection extending upwardly from said top surface, and a complementary recess extending into said bottom surface to receive said projection of an adjacent marker to interlock the markers and prevent tilting of the markers; said projection and said recess being configured to allow adjacent markers to interlock in a plurality of relative circumferential orientations, and said cavities being positioned around said recess between said recess and said outer periphery.

18. The marker of claim 17, wherein said cavity comprises a plurality of radially spaced concentric annular slots, and a plurality of radial slots interconnecting said annular slots; and said annular slots surround said recess.

* * * * *